United States Patent [19]

Turucz

[11] Patent Number: 4,841,647

[45] Date of Patent: Jun. 27, 1989

[54] ACU-PRESSURE MASSAGING INSOLES

[76] Inventor: Sándor Turucz, 211½ South Howell Ave., Chattanooga, Tenn. 37411

[21] Appl. No.: 200,948

[22] Filed: Jun. 1, 1988

[51] Int. Cl.[4] ..... A43B 13/40; A43B 13/38.

[52] U.S. Cl. ..... 36/44; 36/43

[58] Field of Search ..... 36/43, 44, 11.5; 128/25 B, 582

[56] References Cited

U.S. PATENT DOCUMENTS

| | | | |
|---|---|---|---|
| 4,674,203 | 6/1987 | Gouer | 128/582 |
| 4,674,205 | 6/1987 | Anger | 36/44 |
| 4,694,831 | 9/1987 | Seltzer | 36/43 |
| 4,760,655 | 8/1988 | Mauch | 36/43 |

FOREIGN PATENT DOCUMENTS

| | | | |
|---|---|---|---|
| 2619410 | 11/1976 | Fed. Rep. of Germany | 36/11.5 |
| 8304272 | 10/1983 | Fed. Rep. of Germany | 36/43 |
| 8415720 | 9/1984 | Fed. Rep. of Germany | 36/43 |

OTHER PUBLICATIONS

WO 8603384, 6/1986, PCT, Popp.

*Primary Examiner*—Steven N. Meyers
*Attorney, Agent, or Firm*—Alan Ruderman

[57] ABSTRACT

Shoe insoles having convex protuberances extending from the base of the insoles for providing a rhythmic pressure or massaging action on the soles of the feet during walking. The base is a resilient or spongy material while the protuberances are somewhat more firm so that at the wearer of the insoles walks the protuberances sink into the base on the downstep and extend proudly from the base on the lifting portion of the walking gait. The protuberances have geometric forms and are disposed on the base so as to massage certain zones of the soles of the wearer's feet to simulate an acu-pressure massage and walking barefoot on uneven or rough terrain.

6 Claims, 1 Drawing Sheet

ACU-PRESSURE MASSAGING INSOLES

BACKGROUND OF THE INVENTION

This invention relates to insoles for shoes and more particularly to insoles having foot massaging protuberances extending from the upper surface thereof which massage the feet during walking, the massaging being applied at important pressure points in the sole of the feet.

Reflexology or acu-pressure is an ancient technique involving compression or finger massaging at strategic points on the soles of the feet. The essential principle behind reflexology is that the various organs and muscles of the body are connected by a network of nerves to certain spots or zones on the sole of the feet and by massaging these spots a more intensive circulation of blood flows in the target organ. Additionally, there is a theory that there are channels of energy flowing through the body and this energy terminates at these strategic spots in the feet. As circulation in the feet decreases, deposits in the form of crystallized globules form at the nerve endings, and such deposits may be broken up by deep massaging. It is known that such massaging at the various strategic zones brings about a revitalization of the energy level of the person, and theory has it that the massaging unobstructs the flow of energy through these energy channels or pathways from the various organs to the zones in the soles of the feet. Pressure applied to these locations stimulates reflex actions of the organ, muscle or gland corresponding to the energy channel terminating at the zone to which the stimulus is applied. This particular interaction between the organs and its reflective zones on the sole of the feet was well-known in the ancient world. Additionally, it is known that massage applied to specific locations in the feet does relax the body by reducing tension resulting from various stresses, and by so doing provokes good health. Moreover, when acu-pressure foot massage has been performed on people engaged in sports activities, improved competitiveness occurred, apparently due to postponement of fatigue, and increased aptitude for concentration and a greater endurance.

Modern civilization with its emphasis on fashion have resulted in shoe design which may adversely affect the zones of the sole, but at any rate such shoes do hinder the free and necessary movements of the bones of the feet. As a consequence of improperly designed shoes certain muscles become inactive and may atrophy. Another factor resulting in inefficient use of small foot muscles is that of walking on level ground, since the muscles do not receive sufficient stimulus and thus do not develop fully. Such inactivity of these foot muscles may eventually result in the hindering of blood circulation in the feet with the inherent complaints of pain and fatigue. As the muscles weaken the bones take on an added burden and distortions such as fallen arches can be expected. Such distortions eventually result in excessive strain on the spinal column and back problems.

It is known that running or walking on uneven ground such as a lawn, hilly terrain or the seashore has been included in many athletic training programs, and many of these programs were performed barefoot. It is also known that children living in small isolated villages running barefoot in the fields have less skeletal and spinal problems than city bred children, and especially less foot deformation problems. However, walking barefoot on rough terrain is not readily accessible to everyone, nor is acu-pressure massage.

SUMMARY OF THE INVENTION

Consequently, it is a primary object of the present invention to provide shoe insoles having protuberances which act to massage the soles of a person wearing the insoles.

It is another object of the present invention to provide shoe insoles having convex protuberances which when worn by a person walking act to simulate walking barefoot on uneven terrain.

It is a further object of the present invention to provide shoe insoles having convex protuberances which when worn by a person walking act to simulate acu-pressure massaging of the soles of the feet of the person.

It is a still further object of the present invention to provide shoe insoles having protuberances disposed so as to be located at the zones on the sole of the wearer which correspond to important pressure points and exert a rhythmic pressure by a person walking to stimulate and massage the reflex zones and the interstitial tissue in the sole of the feet.

Accordingly, the present invention provides shoe insoles having convex protuberances disposed for engaging various portions of the soles of the feet of a wearer, the protuberances being relatively firm or rigid and being disposed on a resilient or spongy undersurface so that as the wearer walks, the protuberances will sink into the spongy undersurface as weight is placed on the foot and return to the original state as the foot is lifted and weight is removed. Thus, the insoles smoothly adapt to the walking movement of the feet and the protuberances exert a rhythmic pressure or massaging action on the soles of the feet during walking.

The protuberances are located so as to correspond to the zones in the sole which are interrelated to the various organs of the body under the reflexology theory so that acu-pressure massaging occurs. The firmness of the protuberances and the elasticity of the undersurface are such that, although no painful sensations are registered while standing on the insoles, the rhythmic pressure applied to the zone of the sole while walking stimulates stagnant blood circulation and simulates walking barefoot on rough terrain and an acu-pressure massage. At the same time the insoles preclude foot deformation by reenforcing the muscles in the sole and stimulating the bones therein.

The insoles may be formed in the shoe itself, but preferably are inserts which can be used with more than one pair of shoes. The disposition and array of the protuberances although corresponding to the reflex zones may be scaled in accordance with the demands and measurements of the wearer's feet.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENT

Figure 1:
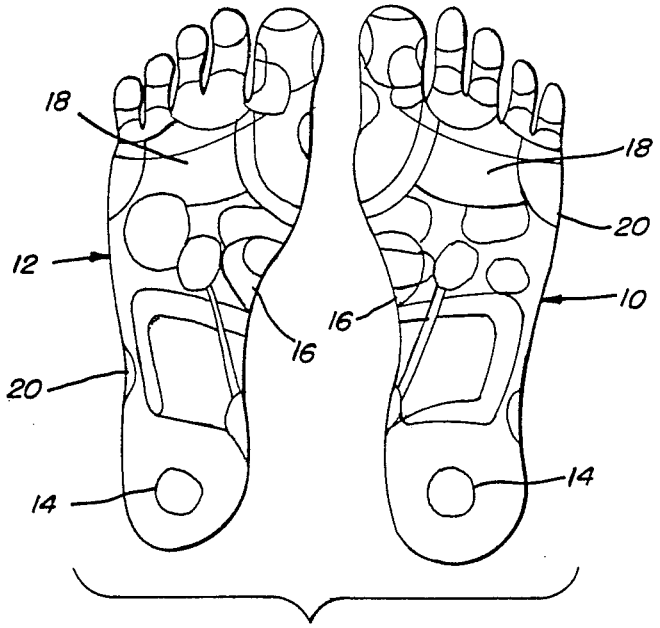
FIG. 1 is a plantar view of the soles of a person's feet illustrating the various pressure zones which are massaged during acu-pressure massaging.

Referring to the drawings, FIG. 1 is a plantar view, i.e., looking up, of the soles of both the left and right foot 10, 12 respectively of a person illustrating certain of the reflex zones to which pressure is applied during acu-pressure massaging, and as such the soles having the zones so indicated are known as sole "maps." in accordance with the reflexology theory, application of rhythmic pressure to the zones effects the well being of the organ of the body connected thereto by either nerves or energy channels which terminate at those zones. The zones are indicated in the heels 14, the arches 16, the balls of the feet 18 and the outer edges 20 of the soles. Although it is not necessary for the present purposes to indicate the organs associated with a particular zone, it may be interesting to note that generally the higher the location of the organ in the body, the closer the corresponding zone in the soles is to the toes and vice versa.

Figure 2:
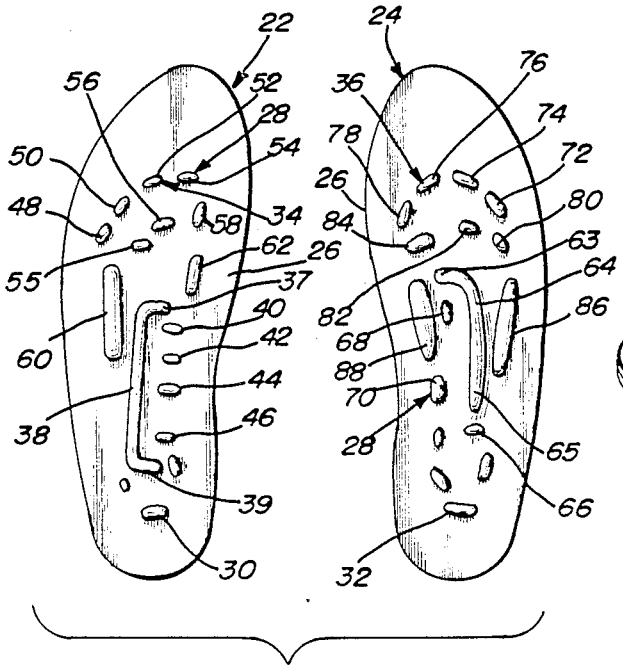
FIG. 2 is a top plan view of a pair of insoles constructed in accordance with the principles of the present invention.
Figure 3:
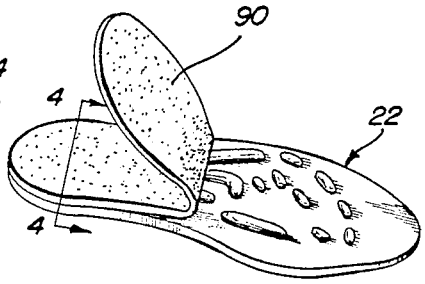
FIG. 3 is a perspective view of one of the insoles.
Figure 4:
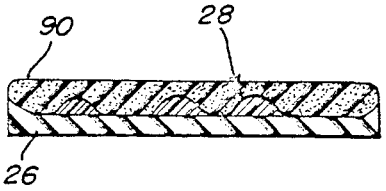
FIG. 4 is a cross sectional view taken substantially along line 4—4 of FIG. 3.

Based on these zones the present invention provides a pair of insoles illustrated in top plan view in FIG. 2, the left insole being indicated at 22, and the right insole being indicated at 24. Each insole comprises a base 26 having an array of spaced protuberances generally indicated at 28 disposed thereon and extending upwardly from the base, the protuberances having configurations and disposed such that they will be superposed below the various reflex zones of the sole "map" when disposed in the shoes of a person wearing the shoes.

The margin or border of the base 26 has a shape such that it will fit the shoe of the wearer and thus the specific size is personallized to the foot size of the user. The height of the protuberances above the upper surface of the base are in the order of 2 to 3 millimeters, while the specific sizes both in length and width will vary with the size of the insole and thus the size of the foot of the wearer. It should be understood that although it is preferred that the insoles be separate from the shoes so as to be utilized with a number of pairs of shoes, they may in accordance with the present invention be permanently affixed to the inner insoles of particular shoes.

The base of the insoles comprises a spongy flexible material such as a resilient plastic or elastomeric material. Examples of such materials include polyethylene, polyurethane, latex and rubber and while the protuberances are relatively rigid and firm they too preferably may be a plastic material such as stiffer forms of the above material, i.e., having durameter values approximately 10–15 higher on a shore 00 scale, which will not register painful sensations, but will sink into or be compressed into the base when the weight of a person wearing the insoles is applied during the downstep portion of the walking gate or the like. During the lifting or upstep portion of the gait while the weight is released or removed, the protuberances return to their original state. Thus, the action of walking creates a rhythmic pressure on the soles of the feet at the locations or zones of the shoes overlying the protuberances and thereby simulates a deep massaging at the zones and also simulates walking barefoot on uneven terrain. Although it is preferable that the base be a single layer of material, it is anticipated that it may be of a ply construction with a spongy inlay disposed between a pair of more firm layers of material.

As illustrated in the drawings, the cross sectional configurations of the protuberances are convex, preferably having the base of the protuberances smoothly and gradually extending out from the base 26 of the insoles. The specific locations of the protuberances, the geometric array and the disposition as to length and width is devised so as to conform to the zones of the sole "map" so as to provide the massaging action to the zones illustrated in FIG. 1. Thus, the right and left insoles have a different and varying array. For example, although both insoles have protuberances in the areas corresponding to the heel, the ball, the arch and the outer edge of the respective sole, certain of these have different geometrical configurations, dispositions and sizes. Although the protuberances 30, 32 in the heel and the protuberances 34, 36 in the ball have substantially the same geometry, those in the central portion adjacent the arch differ. For example, in the left insole there is an elongated protuberance 38 having a substantially C-shaped configuration with the legs 37, 39 thereof facing toward the arch and having a series of small protuberances 40, 42, 44, 46 within the central portion along the arch between the legs of the protuberance 38. An array of seven (7) protuberances 48, 50, 52, 54, 55, 56, 58 are disposed above the protuberance 38 toward the toes in the area corresponding to the ball and bunions of the foot. An elongated protuberance 60 extends adjacent the outer edge of the left insole from an area adjacent the C-shaped protuberance 38 remote from the direction in which the legs face and extending toward the toes into the bunion area. Another elongated but smaller protuberance 62 extends from the upper leg 37 toward the bunion area adjacent the arch. On the right insole, on the other hand, there is an elongated substantially L-shaped protuberance 64 having the tail portion 65 extending in the direction toward the heel and having the lateral leg 63 facing toward the arch. A small protuberance 66 is disposed adjacent the end of the tail with two protuberances 68, 70 in the space adjacent the tail and beneath the lateral leg 63. An array of seven (7) protuberances 72, 74, 76, 78, 80, 82, 84 similar to those in the left insole are disposed above the leg 63 in the ball and bunion area of the sole. An elongated protuberance 86 extends adjacent the outer edge of the right insole and the tail portion of the protuberance and extends toward the toes to approximately the disposition of the lateral leg of the protuberance 64. Another elongated but smaller protuberance 88 extends along the area of the arch from adjacent the extremity of the lateral leg 63 to approximately the center of the insole spaced from the central portion of the tail 65 of the L-shaped protuberances.

As aforesaid, the protuberances act on the zones of the sole of the foot corresponding to the zones illustrated in FIG. 1 except in the toe portion. These act on each foot while walking or the like to stimulate and massage the tissues of the sole of the foot and increase the blood supply to the tissues in a manner similar to an acu-pressure massage as the protuberances cyclically sink and extend from the base. For adding comfort to the wearer, a felt pad 90 or the like may be placed between the protuberances and the foot of the wearer, such pad adding wearability to the insole by absorbing persperation.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. Shoe insoles for massaging the feet of a person wearing said insoles in a shoe or the like, each insole comprising a toe portion, a heel portion, a ball portion adjacent the toe portion, an arch portion and an outer edge portion spaced transversely from said arch portion, a resilient base having an upper surface and a lower surface, said base being adapted to compress in reaction to the weight of a person walking or the like on said insoles, a plurality of spaced protuberances fixedly disposed on the upper surface of said base for applying a rhythmic pressure to the sole of the respective foot of the person while walking or the like, said protuberances being rigid relative to the base for descending into said base in reaction to the weight placed on the respective foot of the person and for extending proud from the base as the weight is removed, said protuberances having convex configurations extending from said base, each of said protuberances having a width varying from the respective length, a first series of said protuberances being spaced apart on the base at the ball portion, at least one protuberance disposed in said heel portion, an elongated protuberance having a longitudinal axis extending substantially in the direction of elongation of said insole and disposed intermediate said heel and ball portions adjacent said arch portion, and a second series of protuberances spaced apart adjacent said elongated protuberance and said arch portion.

2. Shoe insoles as recited in claim 1, wherein said first series comprises an array of seven protuberances disposed with four of said protuberances closer to the toe portion than the other three protuberances.

3. Shoe insoles as recited in claim 2, wherein said elongated protuberance on the insole associated with the right foot is L-shape having the lateral leg thereof remote from the heel and extending toward the arch.

4. Shoe insoles as recited in claim 3, wherein a substantially straight elongated protuberance extending substantially in the direction of elongation of said insole is disposed adjacent the L-shape protuberance remote from the lateral leg and the arch.

5. Shoe insoles as recited in claim 2, wherein said elongated protuberance of the insole associated with the left foot has a C-shape configuration with an elongated bight and a pair of spaced legs, the spaced legs of the C-shaped protuberance extending toward the arch.

6. Shoe insoles as recited in claim 5, wherein a substantially straight elongated protuberance extending substantially in the direction of elongation of said insole is disposed adjacent the bight of the C-shape protuberance remote from the legs.

* * * * *